United States Patent [19]

Hill

[11] Patent Number: 4,629,368

[45] Date of Patent: Dec. 16, 1986

[54] SHIELD SUPPORTS SUITABLE FOR USE IN MINES

[75] Inventor: Nigel Hill, Pershore, England

[73] Assignee: Dowty Mining Equipment Limited, Tewkesbury, England

[21] Appl. No.: 698,602

[22] Filed: Feb. 5, 1985

[30] Foreign Application Priority Data

Feb. 14, 1984 [GB] United Kingdom ..... 03793/84

[51] Int. Cl.[4] ..... E21D 15/44; E21D 19/00

[52] U.S. Cl. ..... 405/296; 405/291

[58] Field of Search ..... 405/291-301; 299/31; 248/357

[56] References Cited

U.S. PATENT DOCUMENTS

| | | | |
|---|---|---|---|
| 4,048,804 | 9/1977 | Elsner et al. | 405/295 |
| 4,197,035 | 4/1980 | Siebenhofer et al. | 405/296 |

FOREIGN PATENT DOCUMENTS

| | | | |
|---|---|---|---|
| 2924210 | 12/1980 | Fed. Rep. of Germany | 405/291 |
| 2080380 | 2/1982 | United Kingdom | 405/295 |
| 840388 | 6/1981 | U.S.S.R. | 405/297 |
| 901557 | 1/1982 | U.S.S.R. | 405/297 |

*Primary Examiner*—Cornelius J. Husar
*Assistant Examiner*—Nancy J. Stodola
*Attorney, Agent, or Firm*—Hayes, Davis & Soloway

[57] ABSTRACT

A shield support, suitable for use in mines, comprising a floor-engaging structure, a roof-engageable canopy, extendible and contractible prop means disposed between the floor-engaging structure and the canopy, and a shield assembly pivotally-connected to the canopy at or near its rearward end portion. The shield assembly includes a lazy tongs linkage, one element of which is pivotally-connected directly to the floor-engaging structure and another element of which is pivotally-connected to the floor-engaging structure through the intermediary of a further element.

6 Claims, 3 Drawing Figures

SHIELD SUPPORTS SUITABLE FOR USE IN MINES

Figure 1:
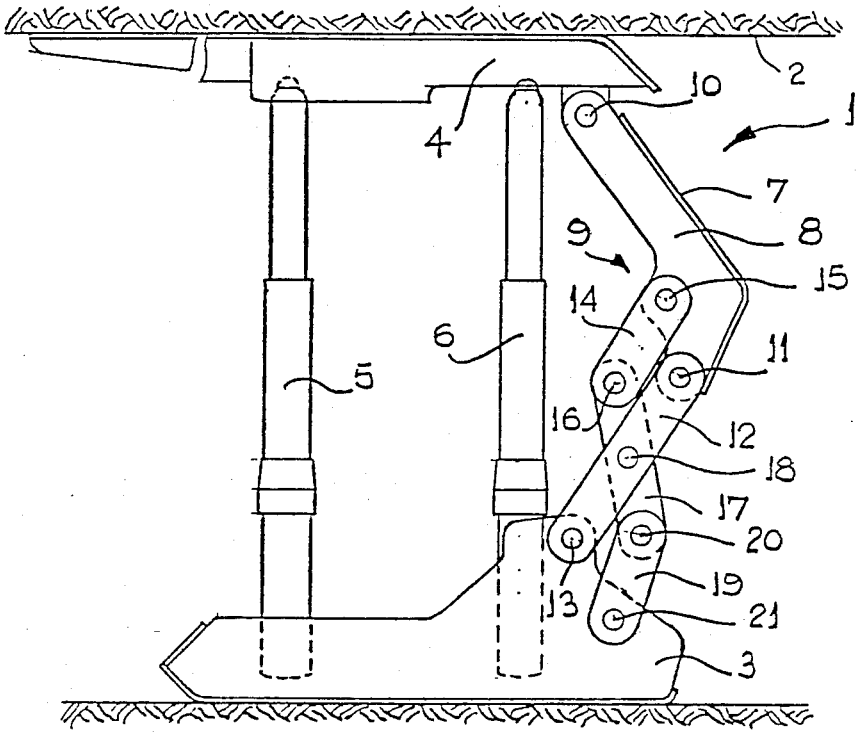

This invention relates to shield supports suitable for use in mines for supporting the mine roof during mineral-mining operations.

Such shield supports are usually of self-advancing type as used in conjunction with conveyor apparatus disposed between a row of said supports and the working face of the mine and extending along the length of the face. This apparatus supports mineral cutting equipment capable of travelling along that apparatus and thus along the face.

Shield supports often include a pivotal guide linkage, sometimes known as a "lemniscate linkage", by which the shield of the support is mounted upon the floor-engaging structure of the support. Such shields are also usually pivotally-connected to the roof-engageable canopy of the support at or near that end portion of the canopy remote from the working face of the mine, that is its rearward end portion.

Prop means carried by the floor-engaging structure support the roof-engageable canopy. These prop means may comprise a plurality of hydraulic telescopic props, the operation of which effects raising of the canopy into load-supporting engagement with the mine roof and lowering of the canopy away from the roof, the guide linkage and shield then unfolding and folding accordingly.

Hitherto however it has been found with this form of guide linkage that when the canopy is in its lowered condition the linkage and shield have so projected rearwardly of the floor-engaging structure of the support as to undesirably increase the overall length of the support. This has been a particular disadvantage during transportation of the support when it is preferred that such overall length is as short as possible to facilitate movement and handling within the mine.

The invention as claimed is intended to provide a remedy. It solves the problem of how to design an improved shield support in which in the lowered condition of the canopy the shield with its linkage projects substantially less beyond the rearward end of the floor-engaging structure of the support than hitherto.

According to this invention a shield support, suitable for use in mines, comprises a floor-engaging structure, a roof-engageable canopy, extendible and contractible prop means disposed between said floor-engaging structure and said canopy, and a shield assembly pivotally-connected to said canopy at or near its rearward end portion and including a lazy tongs linkage one element of which is pivotally-connected directly to said floor-engaging structure and another element of which is pivotally-connected to said floor-engaging structure through the intermediary of a further element.

Preferably said shield assembly comprises a shield element and two of said lazy tongs linkages, one disposed at each side of said shield element and extending therefrom to said floor-engaging structure.

Preferably also said floor-engaging structure comprises a pair of parallel sledges suitably connected together by bridge means and in this case one of said linkages is connected to one sledge and the other of said linkages is connected to the other sledge.

The prop means may comprise four hydraulically-operable props two of which are disposed between one said sledge and said canopy and the other two being disposed between the other said sledge and said canopy.

The advantages offered by the invention are mainly that while with the canopy of the support in its lowered condition the overall length of the support is relatively short, the lazy tongs linkage(s) are such that for raising of the canopy the range of lifting movement remains unimpaired, or substantially so.

Figure 2:
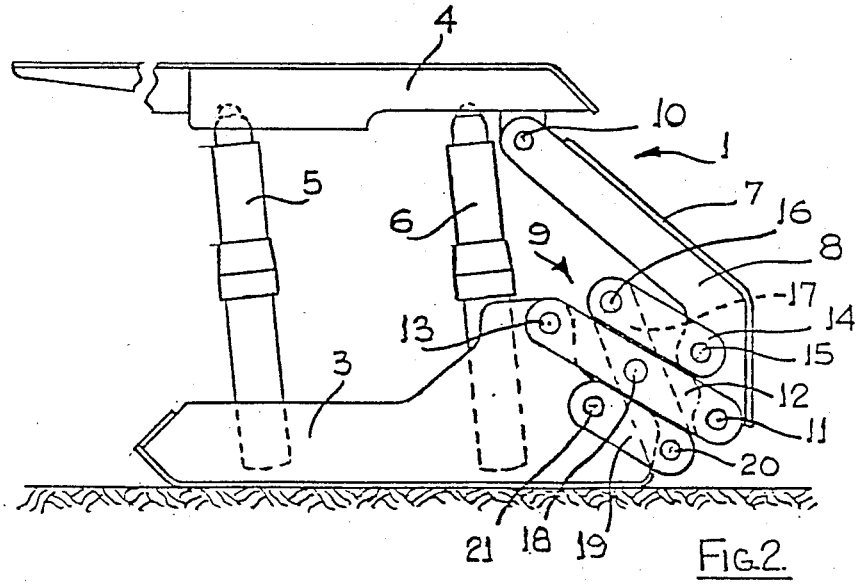
Figure 3:
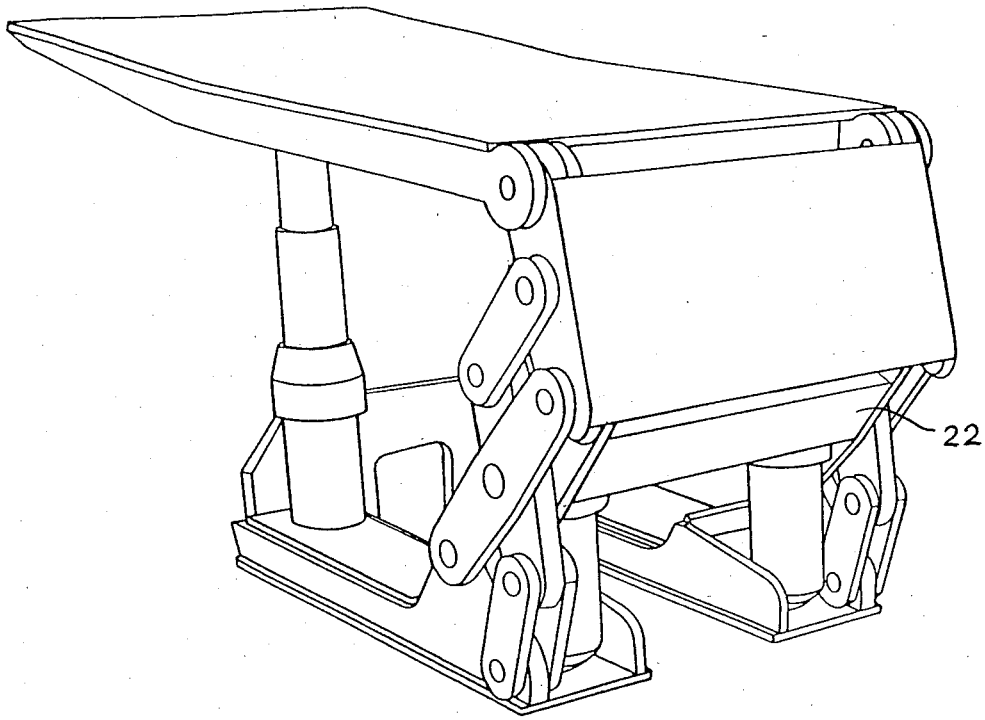

One way of carrying out the invention is described in detail below with reference to drawings which illustrate only one specific embodiment, in which FIG. 1 is a side elevation of a shield support in accordance with the invention in its fully-extended condition, FIG. 2 is a view similar to that of FIG. 1 but with the support in its fully-lowered condition and FIG. 3 is a rear-side view showing a torsion bar, in accordance with the invention, in its fully extended condition.

In the drawings a shield support 1 for use in a mine for supporting the mine roof 2 during mineral-mining operations includes a mine-floor-engaging structure in the form of a pair of parallel sledges, one of which is shown at 3, which are relatively short in length and suitably connected together by bridge means (not shown). The support also includes a roof-engageable canopy 4 and prop means in the form of four hydraulically-operable extendible and contractible props, two of which are, as shown at 5 and 6, disposed between each sledge and the canopy.

A shield element 7 is disposed transversely of the support adjacent the rearward or goaf end portion of canopy 4. This element is secured at each of its two side edges to an element 8 forming one of the links of a respective pivotal guide linkage in the form of what is termed a lazy tongs linkage 9. Both elements 8 are pivotally-connected as at 10 at their upper end portions to the rearward end portion of canopy 4 at transversely spaced positions on the underside thereof.

At its lower end portion each element 8 is pivotally-connected at 11 to one end of an element 12 which is itself directly pivotally-connected at 13 at its other end to a respective sledge 3. Each linkage 9 also includes an element 14 which at one end is pivotally-connected at 15 to element 8 at a position spaced upwardly from pivotal connection 11. At its other end element 14 is pivotally-connected at 16 to one end of an element 17. This element is pivotally-connected at 18 at an intermediate position to an intermediate position on element 12. Thus each of the two lazy tongs linkages 9 disposed at the sides of shield element 7 and extending therefrom to the sledges 3 comprises elements 8, 12, 14 and 17.

The element 17 of each lazy tongs linkage is connected to its sledge 3 through the intermediary of a respective further element 19, one end of which is pivotally-connected at 20 to element 17 and the other end of which is pivotally-connected at 21 to sledge 3 at a position downwardly and rearwardly of pivotal connection 13.

When it is required to lower canopy 4 from the roof-engaging condition shown in FIG. 1, all the props 5, 6 are simultaneously retracted and as such retraction takes place shield element 7 moves downwardly with canopy 4. With this downward movement elements 12, 19 turn in the clockwise direction about their pivotal connection 12, 21 to sledges 3 until when, with the props fully retracted and canopy 4 fully lowered, the linkages 9 reach the condition shown in FIG. 2 in which the elements of the linkages and the shield element are compactly nested between the lowered canopy and the sledges.

When it is required to re-extend the support into engagement with the mine roof 2 the props 5, 6 are extended and thus the canopy is raised, whereupon the elements 12, 19 turn in the anti-clockwise direction about their pivotal connections 13, 21 and shield element 7 moves back to the position shown in FIG. 1.

By the invention, in the lowered condition of the canopy the shield assembly does not extend beyond the rearward ends of the sledges to any undesirable extent so that the overall length of the support remains relatively short and yet the lazy tongs linkages are such that when the canopy is raised the range of lifting movement available remains unimpaired or substantially so.

Also by the invention a relatively short shield element is provided which, in the raised condition of the canopy, is set by the linkages at a relatively steep angle. This is intended to reduce the likelihood of direct roof loading on the shield element which might otherwise inadvertently force the support towards the mineral face and also apply unnecessary loading on equipment associated with the support.

In alternative embodiments of the invention a torsion bar 22 (see FIG. 3) may be connected between one of the elements, for example element 12, of the lazy tongs linkage on one side of the support and the corresponding element of that linkage on the other side of the support. This torsion bar may be of suitable box-like construction and welded or otherwise suitably secured to those elements.

I claim:

1. A shield support, suitable for use in mines, comprising a floor-engaging structure, a roof-engageable canopy, extendible and contractible prop means interconnecting said floor-engaging structure and said canopy for adjustment of the spacing of said canopy from said floor-engaging structure, and a shield assembly, said shield assembly including a shield element pivotally-connected to said canopy proximate the rearward end portion of said canopy and a pivotal guide linkage having first, second, third and fourth elements, each having first and second ends, wherein:

said first end of the first element of said linkage is pivotally connected directly to said floor-engaging structure;

said second end of the first element is pivotally connected directly to said shield element;

a position intermediate said first and second ends of said second element of said linkage is pivotally connected directly to a position intermediate said first and second ends of said first element;

said first end of said second element is pivotally connected directly to said first end of said third element;

said second end of said third element is pivotally connected directly to said floor-engaging structure at a position spaced from said first end of said first element;

said first end of said fourth element is pivotally connected directly to said second end of the second element;

said second end of said fourth element is pivotally connected directly to said shield element at a position spaced from said second end of said first element.

2. A support as claimed in claim 1, wherein said shield assembly includes two of said pivotal guide linkages, one disposed at each side of said shield element and extending therefrom to said floor-engaging structure.

3. A support as claimed in claim 2, wherein said floor-engaging structure comprises a pair of parallel sledges.

4. A support as claimed in claim 3, wherein one of said linkages is connected to one sledge and the other of said linkages is connected to the other sledge.

5. A support as claimed in claim 3, wherein said prop means comprises four hydraulically-operable props, two of which are disposed between one said sledge and said canopy, and the other two being disposed between the other said sledge and said canopy.

6. A support as claimed in claim 2, wherein torsion bar means is connected between at least one of the elements of said pivotal guide linkage on one side of the support and the corresponding elements of said pivotal guide linkage on the other side of the support.

* * * * *